US005344008A

United States Patent [19]

DeBlasio et al.

[11] Patent Number: 5,344,008

[45] Date of Patent: Sep. 6, 1994

[54] PACKAGING FOR ARTICLES SUCH AS CIGARETTES

[75] Inventors: James A. DeBlasio, Midlothian; Donald L. Brookman, Richmond; James B. Draucker, Chesterfield; Donald H. Evers; Charles D. Hansen, both of Richmond; Pamela D. Moore, Chesterfield; Reginald W. Newsome, Richmond; William J. Rech, Midlothian, all of Va.

[73] Assignee: Philip Morris Incorporated, New York, N.Y.

[21] Appl. No.: 70,289

[22] Filed: Jun. 2, 1993

[51] Int. Cl.[5] ..... B65D 85/10

[52] U.S. Cl. ..... 206/256

[58] Field of Search ..... 206/256, 257, 258, 271

[56] References Cited

U.S. PATENT DOCUMENTS

| | | | |
|---|---|---|---|
| 276,171 | 4/1883 | Fraser | 206/256 X |
| 1,870,299 | 8/1932 | Strelitz | 206/258 |
| 2,158,971 | 5/1939 | Stratton | 206/258 |
| 3,226,010 | 12/1965 | Rogers, Jr. | 206/256 X |
| 4,784,261 | 11/1988 | Kutchin | 206/256 |

FOREIGN PATENT DOCUMENTS

| | | | |
|---|---|---|---|
| 3236544 | 4/1984 | Fed. Rep. of Germany | 206/256 |
| 358560 | 10/1931 | United Kingdom | 206/256 |

*Primary Examiner*—William I. Price

*Attorney, Agent, or Firm*—Burns, Doane, Swecker & Mathis

[57] ABSTRACT

A cigarette package comprises a plurality of packs, and a binder member bonded to adjoining edge faces of the packs. A releasable retainer normally holds the packs together. Upon release of the retainer, the packs can be fanned-out about axes coinciding with adjoining corners of the packs. Any number of the packs can be detached by the user for individual use.

22 Claims, 2 Drawing Sheets

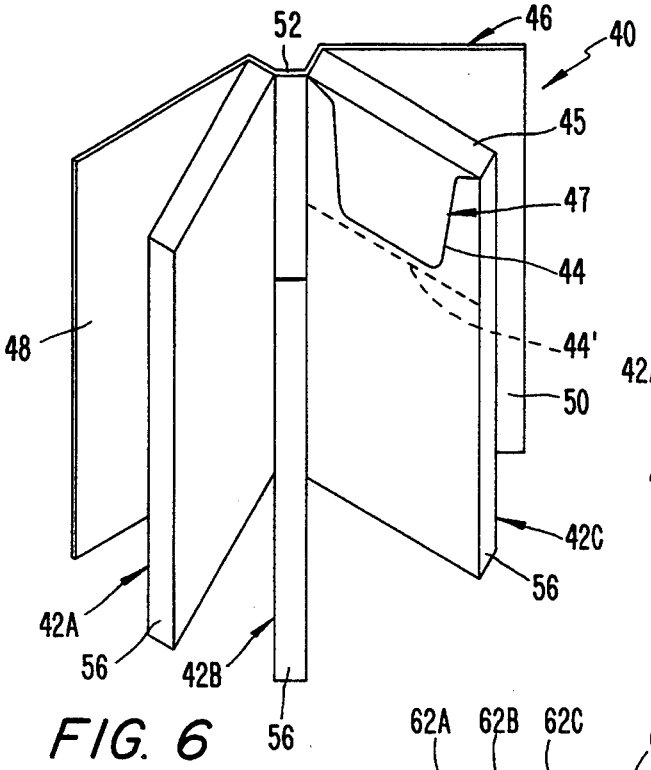
FIG. 6
FIG. 7
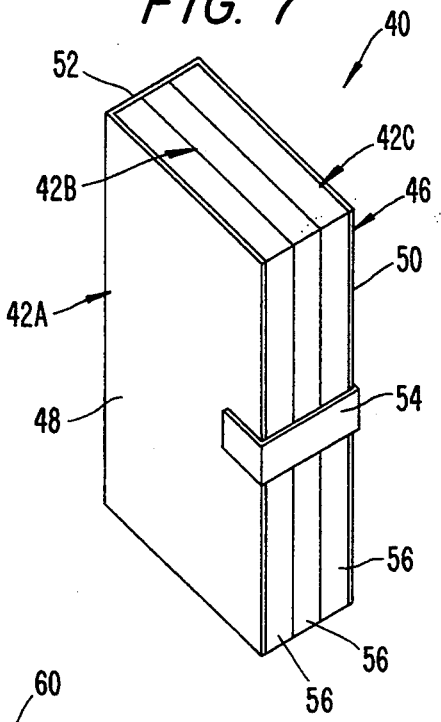
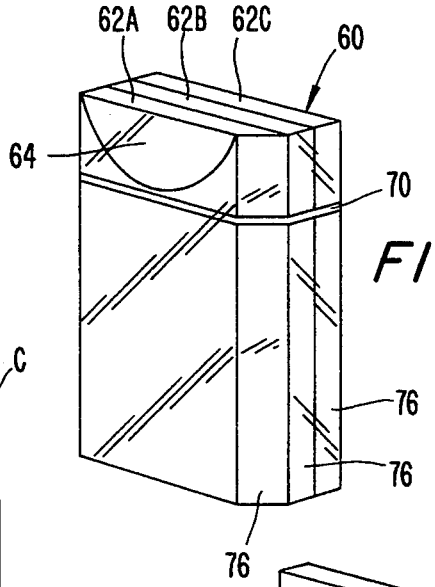
FIG. 9
FIG. 8
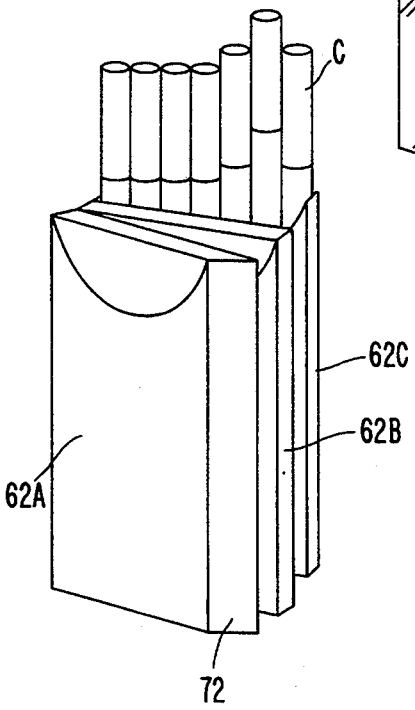
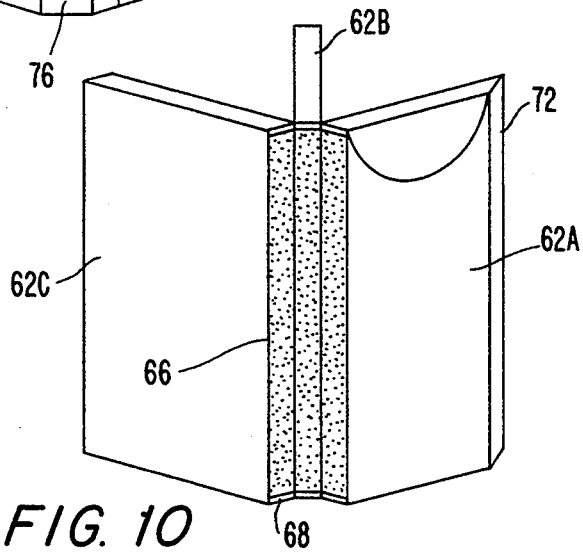
FIG. 10

PACKAGING FOR ARTICLES SUCH AS CIGARETTES

BACKGROUND OF THE INVENTION

The present invention relates to packaging, especially for cigarettes.

It would be desirable to provide a cigarette user with a greater degree of versatility in the carrying of cigarettes, e.g., by reducing the bulk of the pack which is being carried. This should be accomplished, however, without requiring the cigarette user to change his purchasing routine, i.e., without requiring the cigarette user to increase the frequency at which cigarette purchases must be made.

SUMMARY OF THE INVENTION

The present invention relates to a cigarette package which provides such an enhanced versatility. The package comprises a plurality of packs, each containing a plurality of cigarettes. The packs are arranged in a bundle such that the packs are independently swingable about an edge of the bundle and are individually detachable from the package.

Preferably, a binder member is bonded to the packs for permitting the swinging movement to occur.

There is preferably further provided a removable retainer which holds the packs against the swinging movement. Upon removal of the retainer, the swinging movement, and detachment of the packs can occur.

Each pack preferably contains a single row of cigarettes. For example, the row could contain seven cigarettes.

BRIEF DESCRIPTION OF THE DRAWING

The objects and advantages of the invention will become apparent from the following detailed description of preferred embodiments thereof in connection with the accompanying drawing in which like numerals designate like elements and in which:

FIG. 6 is a top perspective view of a second preferred embodiment of a cigarette package according to the present invention, with the individual packs thereof disposed in a fanned-out condition;

FIG. 7 is a top perspective view of the package depicted in FIG. 6, with the packs thereof held together;

FIG. 8 is a perspective view of third preferred embodiment of a cigarette package with the packs thereof bundled together;

FIG. 9 is a view similar to FIG. 8 after a retainer for the bundle has been removed and the packs have been fanned out, one of the packs being opened to expose the cigarettes carried thereby; and FIG. 10 is a perspective view of a bound edge of the package with the packs being fanned-out.

DETAILED DESCRIPTION OF PREFERRED EMBODIMENTS OF THE INVENTION

Figure 1:
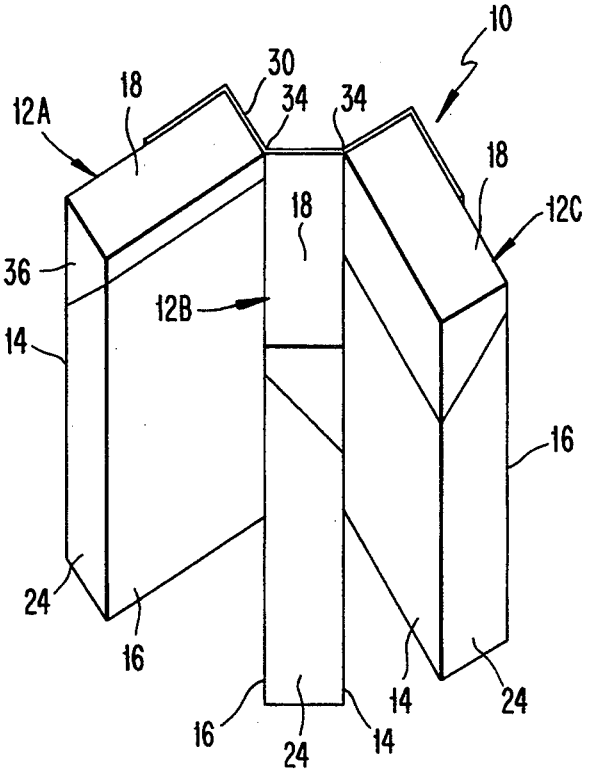
FIG. 1 is a top perspective view of a first embodiment of a cigarette package according to the present invention, with the individual packs thereof being in a fanned-out condition.
Figure 2:
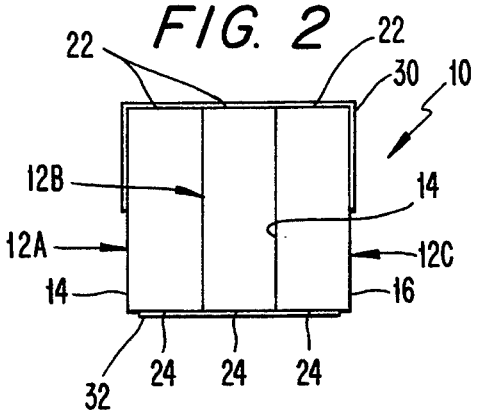
FIG. 2 is a top plan view of a package depicted in FIG. 1, with the packs held together.
Figure 3:
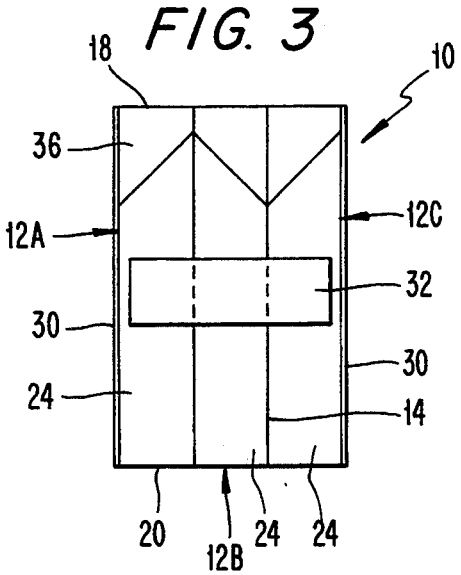
FIG. 3 is a front elevational view of the package depicted in FIG. 2.

A cigarette package 10 depicted in FIGS. 1–3 comprises a plurality of packs, e.g., three rectangular packs 12A, 12B, 12C. Each pack contains a front broad face 14, a rear broad face 16, a top edge face 18, a bottom edge face 20, and two side edge faces 22, 24. The packs are normally arranged in side-by-side relationship (see FIGS. 2, 3) such that the broad faces are in opposing relationship, and the edge faces in side-by-side relationship (see FIG. 2). The edge faces thus form groups of side-by-side edge faces 18, 20, 22, 24, respectively.

The broad faces can be arranged in various relationships. For example, the front face 14 of packs 12B and 12C face one another as shown in FIG. 3. The rear face 16 of pack 12B can face either of the faces 14, 16 of the pack 12A.

The packs 12A–C are held together by retaining elements which include a binder strip 30 and a removable retainer label 32. The binder strip 30 in FIGS. 1 and 2 extends across all of the side edge faces 22 for the full height of the packs, and partially across the exposed broad faces 14, 16, and is bonded to those faces 22, 14, 16. The bonding can be effected by a pressure sensitive permanent adhesive or a no-tack adhesive for example. The binder strip 30 can be formed of any suitably flexible material, such as paper for example. The binder strip 30 could extend less than the full height of the packs if desired.

The packs 12A–C can be detached from the package by the user. In that regard, the adhesive may be of the no-tack releasable type which permits the packs to be detached from the binder strip. Alternatively, if a permanent non-release adhesive is used, then the portions of the binder strip 30 to which respective packs are attached could be detachable from one another, aided for example, by perforating or pre-scoring the binder strip, whereby each pack, together with its associated portion of the binder strip 30, can be detached. Alternatively, the binder strip could comprise a notched directional tear strip.

Normally, the packs are held together as a bundle by a retaining label 32 which is attached by an adhesive to the side edge faces 24 of the packs. That label could be of any suitable size and attached to any of the edge faces 18, 20, 24. By removing the label 32, the packs 12A–C can be moved relative to one another, i.e. fanned-out, about axes defined by adjoining corners 34 of the packs. This enables the packs to be spread apart so that they can be more easily grasped for detachment.

In lieu of a label 32, other retaining elements could be employed such as a polypropylene wrapping (not shown) encasing all of the packs. That wrapping could comprise a full wrap which encompasses all of the packs after the binder strip 30 and retaining label 32 have been applied. Alternatively, the packs could be wrapped individually with a polywrap (i.e., an individual wrap), followed by the application of the binder strip and retaining label to the outsides of all three individual wraps. (Possibly a full wrap could then be applied to encompass all three individually wrapped packs.)

Figure 4:
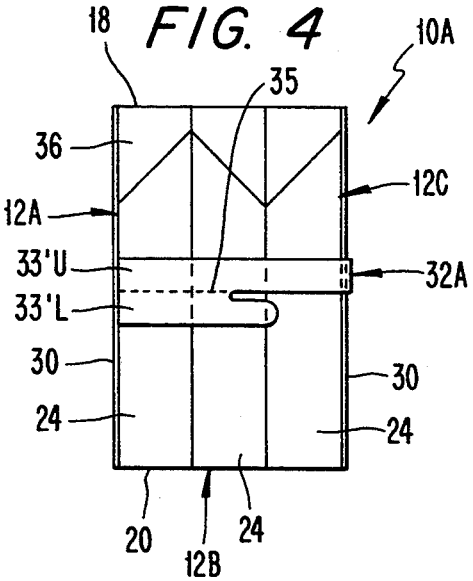
FIG. 4 is a view similar to FIG. 3 depicting a modified retaining label.
Figure 5:
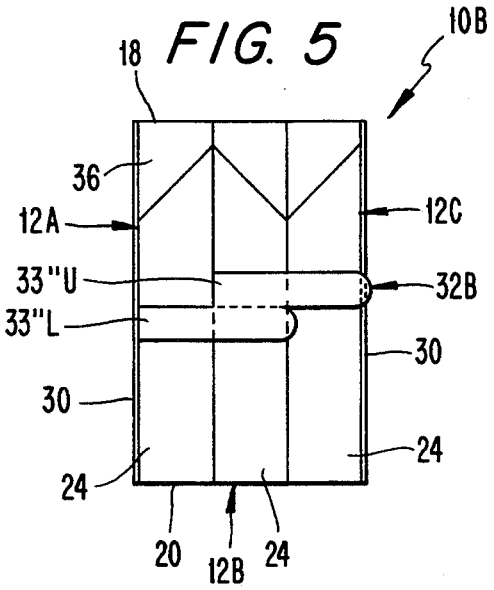
FIG. 5 is a view similar to FIG. 3 depicting another modified retaining label.

FIGS. 4 and 5 depict two alternative arrangements of a retaining label. For example, in FIG. 4 a retaining label 32A comprises upper and lower segments 33'U, 33'L which are jointed together by a separable joint 35 that enables the upper segment 33'U to be separated simultaneously from the packs 12A–C and the lower segment 33'L. The upper segment 33'U is bonded to all three packs 12A–C, whereas the lower segment 33'L is bonded only to the packs 12A, 12B. Each segment includes an extended gripping end to enable a user to grasp such segment. When a user pulls the upper segment 33'U and thus separates that segment from the three packs and from the lower segment 33'L, the pack 12C remains held to the other two packs solely by the binder strip 30, whereas the remaining two packs 12A, 12B are held together by both the binder strip 30 and the segment 33'L of the retaining label 32A. Thus, it is only necessary to separate the portion of the binder strip 30 which is secured to the pack 12C in order to fully separate the pack 12C from the remaining two packs 12A, 12B. The remaining two packs 12A, 12B can later be separated from one another by removing the lower segment 33'L and separating the portions of the binder strip 30 which are adhered to those two remaining packs 12A, 12B.

The embodiment depicted in FIG. 5 is similar to that disclosed in FIG. 4 except that the upper segment 33'U is adhered only to the packs 12B, 12C.

Each pack 12A–C contains a plurality of cigarettes, e.g., a single row of about 5–8 cigarettes. If each pack were to contain a row of seven cigarettes for example, then a package of three packs would contain twenty-one cigarettes which closely approximates the number (twenty) contained in most conventional cigarette packs.

The packs are preferably of the hard pack type having a suitable closure, such as a flip top 36.

A purchaser can, after purchasing the package 10, detach one or more of the packs 12A–C to be carried on his/her person, thereby reducing the bulk of the pack being carried. Since the overall package 10 can contain about the same number of cigarettes as a standard pack of cigarettes, it is not necessary for the cigarette user to increase the number of cigarette purchases. Also, in the preferred embodiment since the small individual packs need only be opened one at a time (following the removal of a full polywrap—if used), only some of the cigarettes of the package will be exposed when a pack is opened; the remaining cigarettes will remain closed, or sealed (in the event that all packs are individually polywrapped).

Any number of packs, more or less then the three depicted, could be provided in a given package 10.

Another preferred embodiment of the invention is depicted in FIGS. 6 and 7. The package 40 of that embodiment comprises three packs 42A, 42B, 42C each being of the hard-pack type having a closure in the form of a tuck-in flap 44. The flap 44 is integral with a top edge 45 of the pack and folds down so that a bottom edge 44' of the flap is located below the bottom of a recess 47 formed in a front face of the pack. The packs 42 A–C are attached by a suitable adhesive to a binder 46 comprised of two stiff end panels 48, 50 and a spine 52. The spine 52 is bonded to the adjoining edge faces of the packs, whereas the panels 48, 50 are not attached to the packs. The packs and panels are normally held together by a retainer, such as a removable label 54, which extends across the end faces 56 of the packs situated opposite the spine 52. The label is also bonded to the exposed faces 48, 50. In lieu of, or in addition to, the use of a label 54, the packs could be encased within a polypropylene wrapper (not shown).

Once the label 54 is removed, the panels 48, 50 and the packs 42A–C can be fanned-out about axes defined by adjoining corners of the packs. The packs 42A–C can be detached by the user, preferably by bonding the packs to the spine by a releasable adhesive which enables the packs to be detached from the binder.

Yet another embodiment of the invention is depicted in FIGS. 8–10. In that embodiment, a package 60 comprises three packs 62A, 62B, 62C each being of the hard-pack type having a closure in the form of a tuck-in flap 64 similar to that of FIGS. 6–7. A binder 66 is attached to the side edge faces 68 of all of the packs to enable the packs to be fanned-out as shown in FIG. 10. As in the earlier described embodiments, the binder can be torn to enable individual packs to be separated. The packs can be individually polywrapped and/or encased by a full wrap to which a tear strip 70 is connected. Alternatively or additionally, a retaining label similar to the earlier described label 32 could be adhered to all of the packs. One of the packs, preferably one of the end packs 62A is beveled at its side edge face 72 located opposite the binder 66, whereas the adjacent side edge faces 74, 76 are non-beveled. The packs 62B, 62C having the non-beveled side edge faces 74, 76 could contain one more cigarette than the pack 62A. Thus, the packs 62B, 62C could each contain seven cigarettes C, while the pack 62A could contain six cigarettes for a total of twenty cigarettes as contained in conventional full-size packs.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed is:

1. A cigarette package comprising a plurality of packs each containing a plurality of cigarettes, said packs being arranged in a bundle such that the packs are independently swingable about an edge of the bundle and are individually detachable from the package; wherein there are three packs in said package; two of said three packs containing a single row of seven cigarettes each, and one of said three packs containing a single row of six cigarettes; and wherein said one pack includes a beveled edge located opposite an edge of the bundle about which the packs are swingable.

2. A cigarette package comprising a plurality of generally rectangular packs, each pack comprising two parallel broad faces interconnected by four edge faces, each pack containing a plurality of cigarettes, said packs arranged together such that such broad faces are in opposing relationship, and said edge faces are side-by-side relationship to form four groups of side-by-side edge faces, and retaining means for holding said packs together including a binder member bonded to one of said groups of edge faces such that said packs are relatively movable about axis defined by adjoining corners of said one group of edge faces, said packs being individually detachable from said package; wherein said retaining means further comprises a removable retainer normally holding said packs against said relative movement; and wherein said removable retainer comprises upper and lower segments joined together by a separable joint, said upper and lower segments being removably attached to different groups of said packs, respectively.

3. A cigarette package according to claim 2, wherein there are three said packs in said package; said upper segment being removably attached to a central one of said packs and to an end one of said packs; said lower segment being removably attached to said central pack and the other end one of said packs.

4. A cigarette package comprising a plurality of generally rectangular packs, each pack comprising two parallel broad faces interconnected by four edge faces, each pack containing a plurality of cigarettes, said packs arranged together such that such broad faces are in opposing relationship, and said edge faces are side-by-side relationship to form four groups of side-by-side edge faces, and retaining means for holding said packs together including a binder member bonded to one of said groups of edge faces such that said packs are relatively movable about axis defined by adjoining corners of said one group of edge faces, said packs being individually detachable from said package; wherein there are three packs in said package; two of said packs containing a single row of seven cigarettes each; one of said packs containing a single row of six cigarettes; and wherein said one pack is beveled along an end edge thereof disposed opposite its edge face to which said binder member is bonded.

5. A cigarette package comprising three packs arranged in a bundle such that said packs can be separated from one another, first and second ones of said packs containing a single row of seven cigarettes each, a third one of said packs containing a single row of six cigarettes; said third pack including two end edges extending parallel to said cigarettes; one of said end edges being beveled.

6. A cigarette packaging comprising a plurality of packs each containing a plurality of cigarettes, said packs being arranged in a bundle such that the packs are independently swingable about an edge of the bundle and are individually detachable from the package; wherein there are at least three packs in said package; each of said packs containing a single row of cigarettes, two packs containing one more cigarette each than one pack; and wherein said one pack includes a beveled edge located opposite an edge of the bundle about which the packs are swingable.

7. A cigarette packaging comprising a plurality of generally rectangular packs, each pack comprising two parallel broad faces interconnected by four edge faces, each pack containing a plurality of cigarettes, said packs arranged together such that such broad faces are in opposing relationship, and said edge faces are side-by-side relationship to form four groups of side-by-side edge faces, and retaining means for holding said packs together including a binder member bonded to one of said groups of edge faces such that said packs are relatively movable about axes defined by adjoining corners of said one group of edge faces, said packs being individually detachable from said package; wherein there are at least three packs in said package; each of said packs containing a single row of cigarettes, two packs containing one more cigarette each than one pack; and wherein said one pack is beveled along an end edge thereof disposed opposite its edge face to which said binder member is bonded.

8. A cigarette package comprising at least three packs arranged in a bundle such that said packs can be separated from one another, each of said packs containing a single row of cigarettes, two packs containing one more cigarette each than one pack; and wherein said one pack includes two end edges extending parallel to said cigarettes; one of said end edges being beveled.

9. A cigarette package according to claim 1, including a binder member boned to said packs permitting the independently swingable movement.

10. A cigarette package according to claim 9, further including a removable retainer holding said packs against the swingable movement.

11. A cigarette package according to claim 1, wherein each pack contains a single row of cigarettes.

12. A cigarette package according to claim 1, wherein each pack contains a single row of seven cigarettes.

13. A cigarette package according to claim 2, wherein said removable retainer extends across another of said groups of edge faces.

14. A cigarette package according to claim 13, wherein said removable retainer is bonded to said other group of edge faces.

15. A cigarette package according to claim 14, wherein said groups of edge faces include a group of top edge faces, a group of bottom edge faces, a group of first side edge faces, and a group of second side edge faces, said binder member being bonded to said group of first side edge faces, and said removable retainer being boned to said group of second side edge faces.

16. A cigarette package according to claim 2, wherein said binder member comprises a spine bonded to said one group of edge faces, and two side panels disposed opposite to two exposed broad faces, respectively.

17. A cigarette package according to claim 16, wherein each of said side panels is swingable independently of said packs about an axis defined by the junction between said side panel and said spine.

18. A cigarette package according to claim 2, wherein there are two or more said packs.

19. A cigarette package according to claim 2, wherein there are three said packs.

20. A cigarette package according to claim 2, wherein each pack contains a single row of cigarettes.

21. A cigarette package according to claim 20, wherein said row is comprised of seven cigarettes.

22. A cigarette package according to claim 2, wherein there are three packs in said package; two of said packs containing a single row of seven cigarettes each; and one of said packs containing a single row of six cigarettes.

* * * * *